United States Patent [19]

Chapman

[11] Patent Number: 4,953,435

[45] Date of Patent: Sep. 4, 1990

[54] REAR-ACCESS TRUSSED NECK CONSTRUCTION FOR STRINGED MUSICAL INSTRUMENTS

[76] Inventor: Emmett H. Chapman, 6011 Woodlake Ave., Woodland Hills, Calif. 91367-3238

[21] Appl. No.: 466,072

[22] Filed: Jan. 16, 1990

[51] Int. Cl.[5] ..... G10D 3/00

[52] U.S. Cl. ..... 84/293

[58] Field of Search ..... 84/293

[56] References Cited

U.S. PATENT DOCUMENTS

| | | | |
|---|---|---|---|
| 2,510,775 | 6/1950 | Forcillo | 84/293 TR |
| 4,074,606 | 2/1978 | Fender | 84/293 TR |
| 4,681,009 | 7/1987 | Mouradian | 84/293 TR |

FOREIGN PATENT DOCUMENTS

| | | | |
|---|---|---|---|
| 138492 | 3/1934 | Fed. Rep. of Germany | 84/293 TR |

*Primary Examiner*—Lawrence R. Franklin
*Attorney, Agent, or Firm*—J. E. McTaggart

[57] ABSTRACT

In an improved trussed neck construction for stringed musical instruments such as guitars, a straight truss rod is disposed in a uniform groove along the rear side of the neck, exposing a surface of the truss along its full length, substantially flush with the rear neck surface. At one end, the truss rod is anchored to the neck, while at the other end it is anchored adjustably to enable correction of unwanted fingerboard curvature, typically concave curvature due to string-tension-induced neck strain. Additional capability is provided to reverse the compensation should this be required, for example to counteract convex fretboard curvature due to neck warpage. The adjustment system, implemented by a machine nut which is adjusted using a wrench, is more rugged than the usual screwdriver system. Adjustment access from the rear of the neck is more convenient than conventional front access. Easy removal of the truss enables field service or replacement without any other disassembly, whereas such removal is difficult or impossible in conventional enclosed truss configurations. The one piece neck configuration and easy assembly of the truss into the neck facilitate original manufacture and provide cost savings. The rear-access trussed neck construction of this invention is applicable to a variety of guitars and other stringed instruments; it has been commercially introduced in a modified version of The Chapman Stick (Registered Trademark, U.S. Pat. Nos. 3,833,751, 3,868,880 and 4,633,754) ten-stringed fingerboard musical instrument, which is related to the guitar family but is played by tapping rather than plucking the strings.

11 Claims, 2 Drawing Sheets

REAR-ACCESS TRUSSED NECK CONSTRUCTION FOR STRINGED MUSICAL INSTRUMENTS

FIELD OF THE INVENTION

The present invention relates to stringed musical instruments such as guitars, and more particularly to an improved trussed neck construction in such instruments.

BACKGROUND OF THE INVENTION

In stringed musical instruments such as guitars the neck region carrying the fretboard or fingerboard is typically made from wood; in some of the higher quality instruments the neck is reinforced by one or more longitudinal metallic truss members, which in accordance with longstanding conventional practice, are fully enclosed within the neck.

When a truss is provided, it is common to include some form of threaded truss adjustment means to control the truss tension so as to correct any curvature in the fingerboard, since generally it is desired to keep the fingerboard substantially flat for uniform finger stopping action on the strings. Such unwanted fingerboard curvature is typically concave, due to the strain induced in the neck by string tension, however the curvature may include an additional component due to residual warpage in the neck.

In conventional practice the adjustment means is accessible only from the front (ie. fingerboard) side of the instrument. Known art utilizing such construction has continued to suffer several drawbacks; in addition to the aesthetic compromises and adjustment difficulties arising from front-access adjustment, the practice of fully enclosing the truss poses a serious serviceability shortcoming: in the event the threaded adjustment means on the truss becomes stripped or the adjustment tool interface such as a screwdriver slot in the end of the truss rod becomes deformed to a point of malfunction, removal of the truss for repair or replacement is extremely difficult, and in fact may be practically impossible, rendering the instrument unrepairable.

Furthermore, most neck constructions of known art fail to provide reverse compensation capability for correcting convex fingerboard curvature.

In common contemporary practice, the truss is constrained in a curved disposition, fully enclosed within a channel formed from a composite neck structure which must be assembled from a plurality of component parts; typical three part configurations comprise (a) a main neck portion, a truss groove filler strip and a fretboard or (b) two half neck parts and a fingerboard part. In a known two part configuration, an arched truss is disposed along a non-uniform groove of varying depth routed in the main neck portion, enclosed by a separate filler part. In such composite structures, fabricating, assembling and fastening the various parts together imposes a substantial premium in the cost of producing the instrument.

OBJECTS OF THE INVENTION

A primary object of the present invention is to provide an improved trussed neck for stringed instruments, including adjustment means, accessible from the rear side of the neck, whereby tension in the truss translated to compressive strain in the rear region of the neck may be controlled so as to remedy concave fingerboard curvature.

A further object is to provide optional reverse compensation capability through the adjustment means, whereby compression in the truss translated to tensile strain in the rear region of neck may be controlled so as to remedy convex fingerboard curvature.

A still further object is that the truss system should allow the neck to be fabricated as a single piece of material, the front side serving directly as a playing surface thus eliminating any need for a separate fingerboard part, and the rear side supporting the truss exposed in a groove, thus facilitating truss/neck assembly and eliminating any need for additional neck parts such as enclosure strips.

It is a still further object that the truss be readily removable for service and replacement.

These and other objects and advantages have been accomplished in the improved trussed neck structure of the present invention in which a substantially straight truss member is disposed uniformly in a groove along the rear side of the neck such that a surface of the truss is exposed along its full length, flush with the rear neck surface.

A full understanding of this invention will be gained through a study of the accompanying drawings along with the following descriptive text.

DETAILED DESCRIPTION

Figure 1:
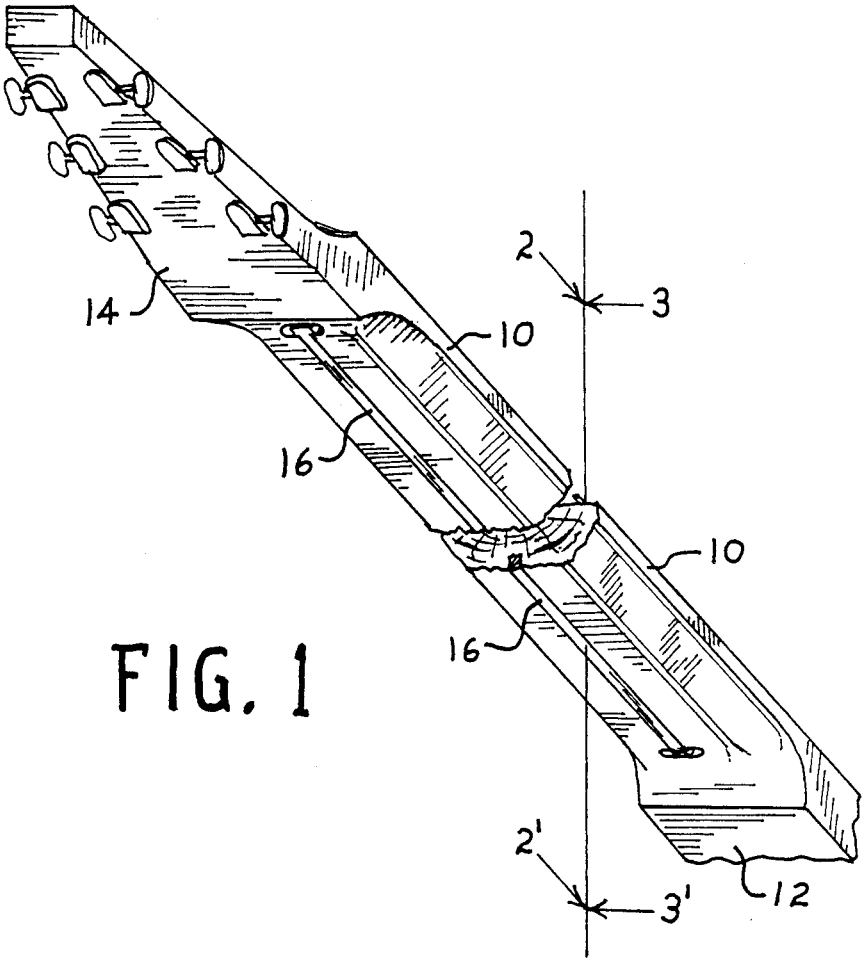
FIG. 1 is a perspective view showing the neck portion of a stringed musical instrument equipped with a truss rod in accordance with the present invention in an illustrative embodiment.

In the perspective view of FIG. 1, neck portion 10 extends between a main body 12, shown in part, and a tuning machine head 14 of a musical instrument such as a guitar. Visible along the rear of the neck 10 is a surface of a truss rod 16.

Figure 2:
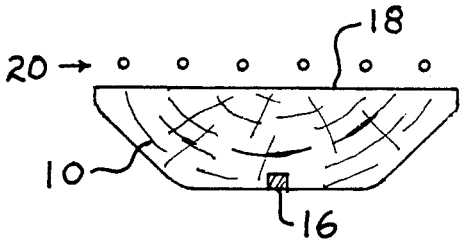
FIG. 2 is cross section of the neck in FIG. 1 through 2—2'.

In the cross section FIG. 2, taken through 2—2' of FIG. 1, the neck 10 is seen to have a roughly half-octagon shape with a substantially flat front surface forming the fingerboard playing surface 18 shown as facing upward, above which are seen a row of strings 20. Truss 16 is seen to have a square cross section, and is recessed in a centrally located close fitting groove running along the rear side of the neck 10 such that the exposed surface of the truss 16 is made to be flush with the adjacent rear surface of neck 10, shown as facing downward.

Figure 3:
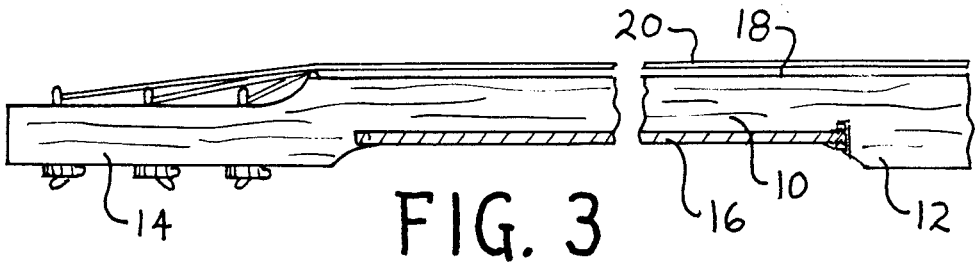
FIG. 3 is cross section of the neck in FIG. 1 through 3—3'.
Figure 4:
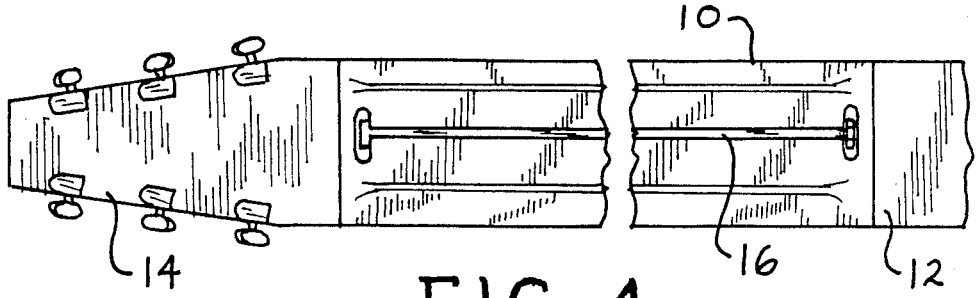
FIG. 4 is a bottom view of the neck of FIG. 1.

In the cross sectional side view FIG. 3 of neck 10, taken through 3—3' of FIG. 1, and in the bottom view FIG. 4 of neck 10, truss 16 is seen running uniformly along the rear region between the main body 12 and the tensioning head 14. Additionally in FIG. 3, a side view of one of the strings 20 is seen immediately above the playing surface 18.

In playing the instrument using the well known normal finger stopping technique, strings 20 are pressed against the fingerboard playing surface 18, which may be fretless as shown, or it may be fitted with conventional frets; in either case, the practice of this invention facilitates a preferred construction in which the fingerboard playing surface 18 may be formed integrally with neck 10, without requiring any separate fingerboard part.

Figure 5:
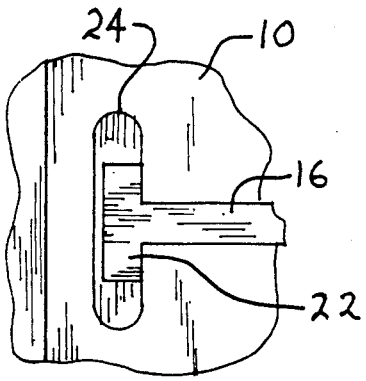
FIG. 5 is an enlarged view of a portion of FIG. 4 showing the anchor region at the left hand end of the truss.

FIG. 5 shows an enlarged view of a portion of FIG. 4 at the left hand end of truss 16, showing in detail how this end of truss 16 is anchored in neck 10. A cross piece 22, at the left hand end of truss 16, is considered longitudinally within a cross groove 24 at the left hand end of the groove containing truss 16.

Figure 6:
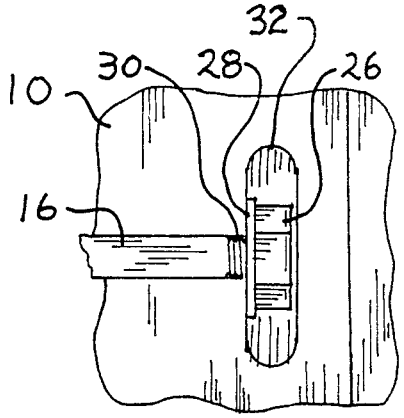
FIG. 6 is an enlarged view of a portion of FIG. 4 showing the region of the adjustable anchor at the right hand end of the truss.

FIG. 6 shows an enlarged view of a portion of FIG. 4 at the right hand end of truss 16, showing the anchored adjustment means comprising a machine nut 26 and washer 28 engaged on a threaded end region 30 of truss 16, the nut 26 and washer 28 being constrained within a cross groove 32 at the right hand end of the groove in which truss 16 is recessed. Cross groove 32 is dimensioned to allow nut 26 to be adjusted by means of a conventional spanner wrench (not shown).

Assembling the truss 16 together with the neck 10 of this invention is simple and straightforward. First, with reference to FIG. 5, the cross piece 22 of truss 16 is placed into cross groove 24 as shown; then, with reference to FIG. 6, washer 28 is placed over the threaded end of the truss 16 and nut 26 is threaded onto the threaded truss end to a suitable distance where truss 16, washer 28 and nut 26 may be pushed into the cross groove 32 as shown. Then the nut 26 is rotationally adjusted by a wrench to introduce a desired bias force in the neck 10.

When the nut 26 is tightened clockwise against washer 28, it should be apparent with reference to FIG. 3 that tension in the truss 16 will transmit a compressive force acting along the rear of the neck 10 tending to counteract any concave arching of playingsurface 18.

As a special feature, the action of the truss may be reversed by rotating nut 26 in the opposite direction so as to force cross piece 22 (FIG. 5) and nut 26 (FIG. 6) endwise against the outermost walls of cross grooves 24 and 26 respectively, thus causing compression set up in truss 16 to transmit a tensile force acting along the rear of the neck 10 tending to counteract any convex arching of playing surface 18. This reverse compensation, while not usually required, may prove useful in special instances for correcting convex curvature where the string tension alone may not provide sufficient corrections.

The neck 10 is typically made from hardwood. As an alternative to the chamfered cross-sectional shape shown in FIG. 2, a rounded or practically other desired shape may be utilized in conjunction with this invention.

The truss 16 is typically made from 0.25 inch square stainless steel stock. The cross piece 22, which may be made from the same square steel stock approximately 0.75 inches long, is fastened onto the end of the truss 16, typically by welding, to form a T shape as shown in FIG. 5. At the other end of truss 16, a length of about 0.5 inch is machined to 0.25 inch diameter and threaded with a pitch of 40 threads per inch, to accept a mating hex nut 26 and washer 28 as shown in FIG. 6.

As an alternative to the square cross-sectional shape shown for the truss 16, it could be made in another rectangular or round shape. Steel cable could be utilized for the truss 16, however the reverse compensation capability feature would not be available. While the preferred embodiment exposes the truss at the rear side, it would be possible to conceal it with a decorative cover cap and to make such a cap easily removable.

The trussed neck configuration of this invention is applicable to a variety of stringed instruments in which the number of strings may differ from the six shown as illustrative, typically ranging from four to twelve.

As an example of utilization in stringed instruments other than conventional guitars, the trussed neck of this invention has been successfully incorporated and tested in a modified version of the Chapman Stick (Registered Trademark, U.S. Pat. Nos. 3,833,751, 3,868,880 and 4,633,754) a ten-stringed instrument related to the guitar family but played by tapping rather than plucking the strings.

A further option would be to utilize two (or more) trusses disposed side by side in the neck with each truss configured in accordance with the teachings of this invention. Also there may be alternative truss anchoring and adjustment implementations, besides those shown as illustrative, adaptable to the basic practice of the invention.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivlency of the claims are therefore intended to be embraced therein.

What is claimed is:

1. An improved trussed neck construction, for a stringed musical instrument, comprising:

an elongated neck having a front side defining a fingerboard region and having at a rear side a rear surface configured with a longitudinal groove;

an elongated metallic truss disposed within said groove substantially flush with the rear surface;

anchoring means disposed at a first end of said truss, adapted to constrain said truss longitudinally relative to said neck; and adjustment means, disposed at a second end of said truss and thus accessible from the rear side of the neck, comprising an adjustment part adapted to adjustably constrain said truss longitudinally relative to said neck.

2. The trussed neck construction as defined in claim 1 wherein said neck is fabricated from a single piece of wood which is adapted to provide an integral fingerboard playing surface on said front side.

3. The trussed neck construction as defined in claim 1 wherein said neck is made to have a substantially flat fingerboard playing surface, and wherein the rear side is configured with a facet defining a substantially flat longitudinal rear surface, parallel to the playing surface, divided centrally by the groove, the facet being flanked by a pair of flat chamfered surfaces.

4. The trussed neck construction as defined in claim 1 wherein the truss is made rectangular in cross-section and the groove is dimensioned so as to closely surround the truss on three sides while leaving exposed a fourth side of the truss.

5. The trussed neck construction as defined in claim 4 wherein the truss is made square in cross-section.

6. The trussed neck construction as defined in claim 1 wherein said anchoring means comprises an enlarged portion of said truss, disposed at a first end of thereof, constrained longitudinally within an enlarged region of the groove, disposed at a first end of said neck.

7. The trussed neck construction as defined in claim 6 wherein said enlarged portion of said truss comprises a cross piece defining a T shape, and said enlarged region of the groove is configured as a cross groove defining a T shape dimensioned to receive said cross piece and thus anchor the first end of said truss within the first end of said neck.

8. The trussed neck construction as defined in claim 6 wherein said adjustment means comprises:

an externally threaded portion of said truss, extending to a second end thereof; and a threaded nut engaging said threaded truss portion, said nut being constrained longitudinally within a cross groove configured at a second end of the longitudinal groove;

whereby rotational adjustment of said nut in a first direction is enabled to set up a tensile force in said truss, reacting on said neck in a manner tending to counteract concave curvature along said fingerboard region.

9. The trussed neck construction as defined in claim 8 wherein said nut, said truss and said cross grooves are dimensioned so as to enable said nut, when adjusted in a direction opposite to said first direction, to set up a compressive force in said truss, reacting on said neck in a manner tending to counteract convex curvature along said fingerboard region.

10. An improved neck, in a stringed musical instrument, comprising:

an elongated truss disposed within a longitudinal groove disposed uniformly along a rear side of the neck, the groove being dimensioned to support the truss substantially flush with adjacent surfaces of the rear side;

anchoring means, disposed at a first end of said truss, adapted to constrain said truss longitudinally relative to said neck; and adjustable anchoring means, disposed at a second end of said truss, adapted to adjustably constrain said truss longitudinally relative to said neck.

11. An improved neck, in a stringed musical instrument, comprising:

a pair of elongated trusses disposed side by side, each within a longitudinal groove disposed uniformly along a rear side of the neck, each groove being dimensioned to support a corresponding one of said pair of trusses substantially flush with adjacent surfaces of the rear side;

anchoring means, disposed at a first end of each truss, adapted to constrain each truss longitudinally relative to said neck; and adjustable anchoring means, disposed at a second end of each truss and thus accessible from the rear side of the neck, adapted to adjustably constrain each truss longitudinally relative to said neck.

* * * * *